US005570964A

United States Patent [19]

Bedol

[11] Patent Number: 5,570,964

[45] Date of Patent: Nov. 5, 1996

[54] GLUE STICK APPARATUS FOR A RING BINDER

[76] Inventor: Mark A. Bedol, 3423 Yankton Ave., Claremont, Calif. 91711

[21] Appl. No.: 461,767

[22] Filed: Jun. 5, 1995

Related U.S. Application Data

[63] Continuation of Ser. No. 236,511, Apr. 28, 1994, abandoned.

[51] Int. Cl.[6] ..... B43K 21/08; A45D 40/20; B42D 3/00

[52] U.S. Cl. ..... 401/75; 401/87; 401/88; 281/31

[58] Field of Search ..... 401/8, 48, 49, 401/87, 88, 98, 131, 195, 75, 175; 281/30, 31; 7/160; D19/27, 44, 46, 77, 57, 91, 81, 36

[56] References Cited

U.S. PATENT DOCUMENTS

| | | | |
|---|---|---|---|
| D. 318,489 | 7/1991 | Cho-Kai | D19/36 |
| D. 324,879 | 3/1992 | Morgan | D19/36 |
| D. 330,912 | 11/1992 | Otake | D19/66 |
| 1,947,738 | 2/1934 | Reutter | 401/75 |
| 2,677,376 | 5/1954 | Brunner | 281/29 |
| 4,580,920 | 4/1986 | Schmidt | 401/75 |
| 4,950,094 | 8/1990 | Yorks | 401/75 |
| 5,067,836 | 11/1991 | Khan | 401/195 X |

FOREIGN PATENT DOCUMENTS

| | | | |
|---|---|---|---|
| 369876 | 1/1907 | France | 401/75 |
| 1396190 | 5/1964 | France | 401/195 |

*Primary Examiner*—Robert A. Hafer
*Assistant Examiner*—D. Neal Muir

[57] ABSTRACT

The glue stick apparatus for a ring binder comprises a housing having a peripheral edge with at least one hole being sized so as to accommodate a ring of a ring binder. The housing has a chamber formed therein. A glue stick support assembly is supported within the chamber of the housing. A glue stick is supported by the glue stick support assembly. The glue stick support assembly includes a rotatable knob and a threaded rod integrally connected to the knob and extending along a longitudinal axis of the chamber within the housing. A glue stick support member has an opening for threadable engagement with the threaded rod.

7 Claims, 1 Drawing Sheet

GLUE STICK APPARATUS FOR A RING BINDER

This is a continuation of application Ser. No. 08/236,511 filed on Apr. 28, 1994, abandoned.

BACKGROUND OF THE INVENTION

1. Field of the Invention

The present invention relates to glue sticks and more particularly to a glue stick apparatus which may be securely stowed in a ring binder.

2. Description of the Related Art

Users of ring binders often have a desire to organize and store items associated with the use of the ring binder. To this end, the present applicant has patented a notebook organizer (U.S. Pat. No. 5,058,736, entitled NOTEBOOK ORGANIZER INCLUDING SLIDABLE ELEMENT, issued Oct. 22, 1991) which generally comprises a base having a substantially flat bottom surface and a border with a plurality of holes therethrough, the holes being adapted for engagement with the rings of a ring binder. The base includes a plurality of partitions dividing the base into a plurality of compartments. There is at least one lid associated with at least one of the compartments, including means for connecting the lid to the base. The lid has a substantially flat upper surface.

The '736 device is an efficient, space-saving means for storing several functional elements. The present invention further enhances the utility of ring binders by eliminating the need for a glue stick to be held separately from the binder.

SUMMARY OF THE INVENTION

The present invention is a glue stick apparatus for a ring binder. In its broadest aspects it comprises a housing having a peripheral edge with at least one hole being sized so as to accommodate a ring of a ring binder. The housing has a chamber formed therein. A glue stick support assembly is supported within the chamber of the housing. A glue stick is supported by the glue stick support assembly.

Preferably, the glue stick support assembly includes a rotatable knob and a threaded rod integrally connected to the knob and extending along a longitudinal axis of the chamber within the housing. A glue stick support member has an opening for threadable engagement with the threaded rod.

Previous to this invention glue sticks have typically had round shapes and have been contained in containers that are not portable or conveniently transportable when outside of the office. It is very difficult to conveniently carry a typical glue stick when leaving the office. The user generally places it in his/her pocket and carries it until the time comes that he needs the glue.

Persons that use organizers or are carrying binders for business or personal matters are now able to insert the present invention into the rings of the binder or organizer and conveniently have it ready, for example, when the time comes for traveling in a car or in an airplane or at a restaurant or other location when the need arises to glue two pieces of paper together. The person takes the glue stick out of the organizer and accomplishes a previously difficult task, gluing when on the go.

The invention may utilize a permanent type of glue material or a tacky glue type of glue material. Tacky glue is very convenient for use on a piece of paper (perhaps a piece of paper from the organizer or binder) to stick the paper on an office door, desk, computer terminal, or wall etc. leaving a convenient, and in some cases, important message that could only have been accomplished because of the tacky glue that was conveniently carried in the organizer or binder.

Heretofore, it was not believed possible to effectively insert a glue stick into the rings of a binder. As will be disclosed below the geometry of the present glue stick support member and complementary shape of the housing provide such a unique capability. The invention also includes other novel features that make it particularly useful such as fins with ring holes. Many glue companies have tried to make glue containers convenient to use but no glue company has ever been able to solve the problem of transporting glue containers while traveling, in a convenient manner.

Other objects, advantages and novel features of the present invention will become apparent from the following detailed description of the invention when considered in conjunction with the accompanying drawings.

BRIEF DESCRIPTION OF THE DRAWINGS

The same elements or parts throughout the figures of the drawings are designated by the same reference characters.

DETAILED DESCRIPTION OF THE PREFERRED EMBODIMENTS

Figure 1:
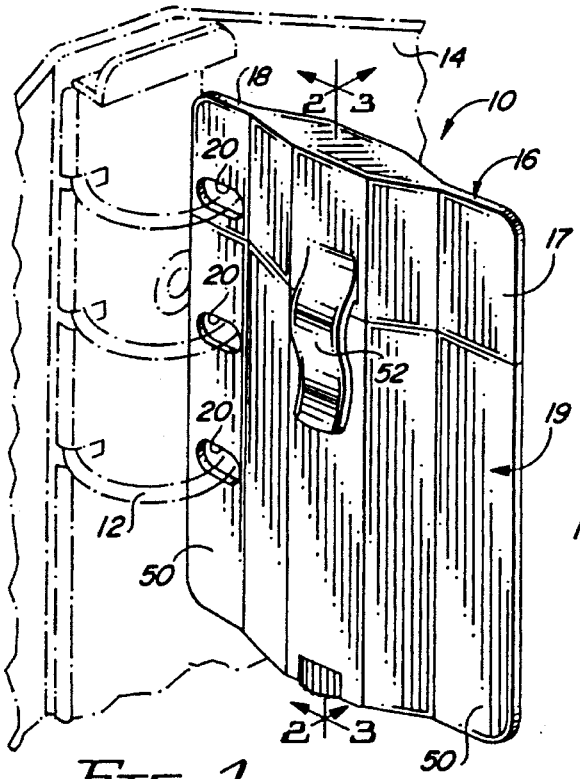
FIG. 1 is a perspective illustration of a ring binder supporting the glue stick apparatus of the present invention, the apparatus having the cap attached.

Referring to the drawings and the characters of reference marked thereon, FIG. 1 illustrates the glue stick apparatus of the present invention, designated generally as 10, being supported by a ring 12 of a ring binder designated generally as 14. The glue stick apparatus 10 comprises a housing 16 having a peripheral edge 18 with at least one hole 20 sized so as to provide access to the ring 12.

Figure 2:
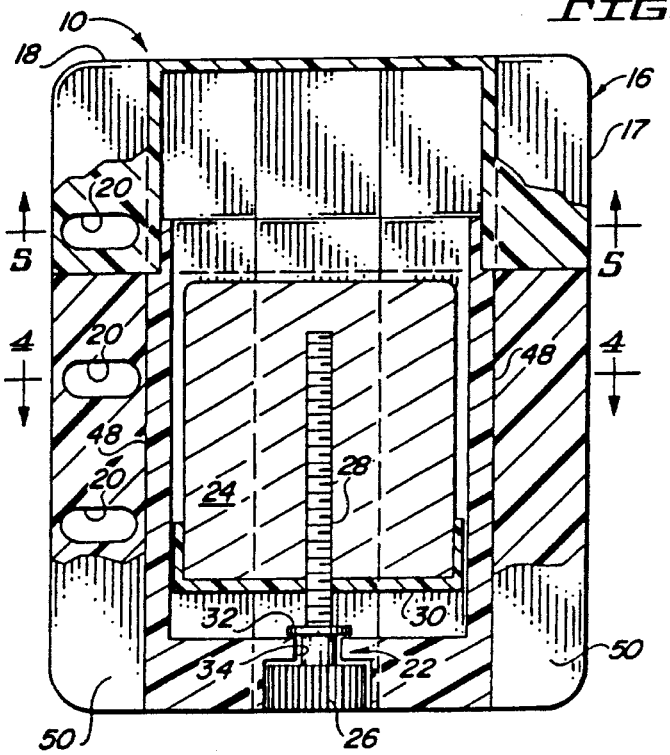
FIG. 2 is a top planar view of the glue stick apparatus of the present invention taken along line 2—2 of FIG. 1.

Referring to FIG. 2, it can be seen that a glue stick support assembly, designated generally as 22 supports the glue stick 24. The glue stick support assembly 22 includes a rotatable knob 26. A threaded rod 28 is integrally connected to knob 26. The rod 28 extends along a longitudinal axis of a chamber formed within the housing 16. A glue stick support member 30 has an opening for threadable engagement with the threaded rod 28. Rod 28 and knob 26 are preferably one piece.

Back end of housing 16 includes an opening formed by an inwardly extending flange 32. Knob 26 has a recessed portion 34 which engages flange 32. Flange 32 is maintained within the recessed portion 34 and prevents axial movement of the knob 26 and rod 28 relative to the housing 16.

The support member 30 and glue stick 24 have a defined geometry which is complementary to the geometry of the inner surface 36 (see FIG. 4) of the housing 16 so as to prevent relative rotation of the support member 30 and glue stick 24 relative to the housing 16. It is understood that the six-sided shape illustrated as the preferred embodiment shown herein is an example of a shape which prevents relative rotation and is shown by way of illustration and not limitation.

Figure 3:
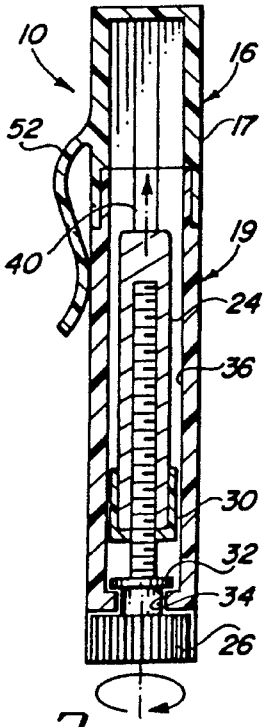
FIG. 3 is a side view of the glue stick apparatus, taken along line 3—3 of FIG. 1.

Referring now to FIG. 3 it can be seen that when the knob is rotated as shown by arrow 38 the support member 30 moves upward toward the upper end of the housing 16, as illustrated by arrow 40. As noted above, rotation of support member 30 is prevented because of its complementary geometry with inner surface 36 of housing 16.

Persons that use organizers or are carrying binders for business or personal matters are now able to insert the present invention through the rings of the binder or organizer and conveniently have it ready when the time comes when traveling in a car or in an airplane or at a restaurant when the need arises to glue two pieces of paper together.

The invention can be filled with a permanent type of glue or tacky glue. The tacky glue is very convenient to use on a piece of paper from the organizer or binder so that the paper may be stuck on an office door, desk, etc. "POST IT"™ brand pads of paper are presently popular when one desires to stick a small note paper on an item. With the present invention the user makes his own tacky messages on paper from his organizer or binder. The user is not limited to the size of "POST IT"'s that happen to be available.

Various types of permanent type of glue may be used. The following is an example of one such type, described for the purposes of illustration and not limitation:

PVP 25%, water 50%, glycerine 15%, other misc. materials 10%. (When manufacturing the glue, some adjustments of the components will result in a tacky glue rather than a permanent glue.)

Figure 4:
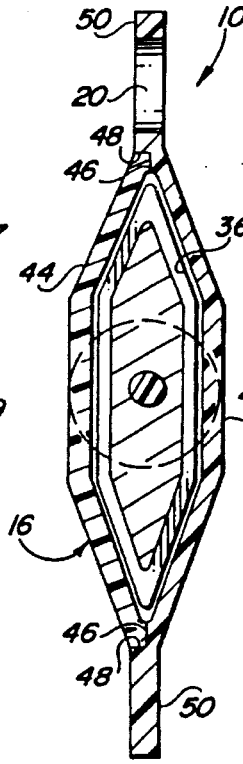
FIG. 4 is a view of the glue stick apparatus, taken along line 4—4 of FIG. 2.

Referring now to FIG. 4 it can be seen that housing 16 preferably includes a first plate 42 and a second plate 44. The first plate 42 has two elongated recessed portions 46 which are attached to two respective sides 48 of the second plate 44. Thus, the chamber for the glue stick is formed between the first and second plates. This provides inexpensive and expedient manufacturing of the invention.

Figure 5:
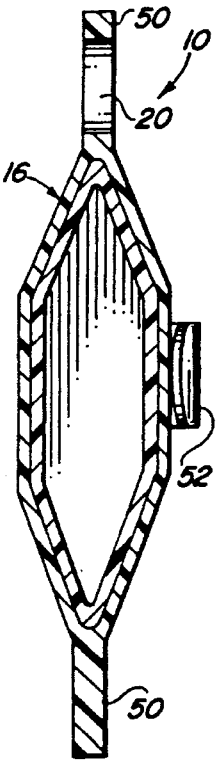
FIG. 5 is a view of the glue stick apparatus, taken along line 5—5 of FIG. 2.

As can easily be seen in FIGS. 4 and 5, the first plate 42 has two fins 50. One of the fins 50 includes the peripheral edge 18 with holes 20. The fin 50 on the other side is primarily aesthetic, providing a streamlined symmetric appearance.

Referring again to FIG. 1, a clip 52 may be utilized to allow the device 10 to be optionally clipped onto paper, a shirt pocket or other desired objects.

A cap 17 is attachable, preferably by friction fit, to the remainder 19 of the housing 16.

Obviously, many modifications and variations of the present invention are possible in light of the above teachings. It is therefore to be understood that, within the scope of the appended claims, the invention may be practiced otherwise as than as specifically described.

What is claimed and desired to be secured by Letters Patent of the United States is:

1. A glue stick apparatus for a ring binder, comprising:

a housing having a peripheral edge with at least two holes being sized so as to accommodate a ring binder, said housing having a chamber formed therein, said housing including an opening formed by an inwardly extending flange on a back end thereof;

a glue stick support assembly supported within said chamber of said housing said glue stick support assembly, comprising:

a rotatable knob having a recessed portion;

a threaded rod integrally connected to said knob and extending along a longitudinal axis of said chamber within said housing; and a glue stick support member having an opening for threadable engagement with said threaded rod; and a glue stick supported by said glue stick support assembly, wherein said flange is maintained within said recessed portion to prevent axial movement of said knob and said threaded rod relative to said housing.

2. The apparatus of claim 1 wherein said support member has a defined geometry and slides through said chamber along an inner surface of said housing, said inner surface having a complementary geometry to said defined geometry so as to prevent relative rotation of said support member and said housing; and, wherein said defined geometry comprises planar surfaces.

3. The apparatus of claim 1 wherein said housing comprises:

a first plate having two recessed portions therein;

a second plate having two sides being attached to said recessed portions, said chamber being formed between said first and second plates.

4. The apparatus of claim 1 wherein said housing comprises:

a first plate having at least one fin including said peripheral edge; and a second plate attached to said first plate, said chamber formed between said first and second plates.

5. The apparatus of claim 1 further including a clip attached to said housing to allow said apparatus to be attached to another object.

6. The apparatus of claim 1 wherein said support member has a defined geometry and slides through said chamber along an inner surface of said housing, said inner surface having a complementary geometry to said defined geometry so as to prevent relative rotation of said support member and said housing; and, wherein said defined geometry comprises planar surfaces.

7. A glue stick apparatus for a ring binder, comprising:

a housing having a peripheral edge with at least two holes being sized so as to accommodate a ring binder, said housing having a chamber formed therein, said housing having length and width dimensions which are substantially greater than its thickness dimension, so as to maximize useable space within said ring binder;

a glue stick support assembly supported within said chamber of said housing, said glue stick support assembly comprising:

a rotatable knob;

a threaded rod integrally connected to said knob and extending along a longitudinal axis of said chamber within said housing; and a glue stick support member having an opening for threadable engagement with said threaded rod; and a glue stick supported by said glue stick support assembly, wherein, said support member has a defined geometry and slides through said chamber along an inner surface of said housing, said inner surface having a complementary geometry to said defined geometry so as to prevent relative rotation of said support member and said housing; and, wherein said defined geometry comprises planar surfaces.

* * * * *